United States Patent [19]

Hotta et al.

[11] Patent Number: 4,615,938

[45] Date of Patent: Oct. 7, 1986

[54] DYE-RECEIVING SHEETS FOR THERMAL RECORDING

[75] Inventors: Shu Hotta, Osaka; Tokihiko Shimizu, Nara; Nobuyoshi Taguchi, Ikoma, all of Japan

[73] Assignee: Matsushita Electric Industrial Co., Ltd., Japan

[21] Appl. No.: 678,489

[22] Filed: Dec. 5, 1984

[30] Foreign Application Priority Data

Dec. 7, 1983 [JP] Japan ..... 58-230811

[51] Int. Cl.[4] ..... B41M 5/26

[52] U.S. Cl. ..... 428/323; 8/471; 8/472; 346/135.1; 428/195; 428/206; 428/328; 428/329; 428/331; 428/913

[58] Field of Search ..... 8/471, 472; 428/195, 428/206, 207, 323, 328–331, 913, 914; 346/135.1

[56] References Cited

U.S. PATENT DOCUMENTS 4,474,859 10/1984 Oshima et al. ..... 428/913

4,505,975 3/1985 Majima ..... 428/914

*Primary Examiner*—Bruce H. Hess

*Attorney, Agent, or Firm*—Lowe, Price, Leblanc, Becker & Shur

[57] ABSTRACT

Dye-receiving sheets for thermal recording which comprise a support and a dye-developing or receiving layer formed on the support. The layer is made of a composition comprising a dispersion of inorganic fine particles uniformly dispersed throughout a binder of a mixture comprising a first resin having good dye receptivity or good affinity for dyes and a second resin immiscible with the first resin. The binder mixture of two different types of resins allows microscopic interstices to exist at or along boundaries of the resins, through which interstices dye molecules penetrate and chemically combine with and/or adsorb on active sites of the inorganic particles and the first resin.

6 Claims, 3 Drawing Figures

DYE-RECEIVING SHEETS FOR THERMAL RECORDING

BACKGROUND OF THE INVENTION

1. Field of the Invention

This invention relates to thermal recording and more particularly, to dye-receiving sheets useful in thermal recording systems.

2. Description of the Prior Art

Many attempts have been heretofore made to carry out thermal transfer recording utilizing sublimation properties of dyes so that high speed recording is possible. However, recorded images obtained from dyes have disadvantages in that they are poor in stabilities including light resistance and are low in recording density. These disadvantages are chiefly attributed to insufficient dye receptivity of a color-developing layer by dye-receiving sheets, on which dyes are deposited or received.

SUMMARY OF THE INVENTION

It is an object of the present invention to provide dye receiving sheets for thermal recording which are effectively utilized in high speed recording system using electronic devices such as thermal heads or laser beam generators.

It is another object of the invention to provide dye receiving sheets for thermal recording which are capable of providing dye images having good light resistance and high recording density.

The dye receiving sheets according to the invention are characterized by a color-developing layer which is made of a composition comprising a fine powder of inorganic materials uniformly dispersed throughout a mixture of a first resin having good dye receptivity and good affinity for dyes and a second resin immiscible with the first synthetic resin. The resin mixture serves as a binder for the inorganic powder. Because the two different types of resins which are immiscible with each other are used, microscopic interstices are formed at or along boundaries between the regions of the respective resins, through which dye molecules can readily penetrate.

DETAILED DESCRIPTION AND PREFERRED EMBODIMENTS OF THE INVENTION

The dye-receiving sheets for thermal recording according to the invention comprise a support and a color-developing layer formed on the support. The color-developing layer is made of a resin composition which comprises fine inorganic particles having a size below 10 μm uniformly dispersed throughout a resin mixture of a first resin having good dye receptivity and a second resin immiscible with the first resin. The inorganic particles should preferably have an average size as small as below 500 angstrom. Smaller particles are preferred if available. In practice, the preferable size is from 50 to 500 angstrom.

Dye molecules generated from a dye layer by application of heat are adsorbed or deposited on the inorganic particles and the dye-receptive resin at adsorption or deposition points or sites of the particles and the dye-receptive resin. These points or sites of the particles and the dye-receptive resin are generically called color-developing points or sites. The second resin which is immiscible with the first dye-receptive resin contributes to increase a density of effective color-developing sites with an attendant increase of recording density as will be more particularly described later.

Figure 1:
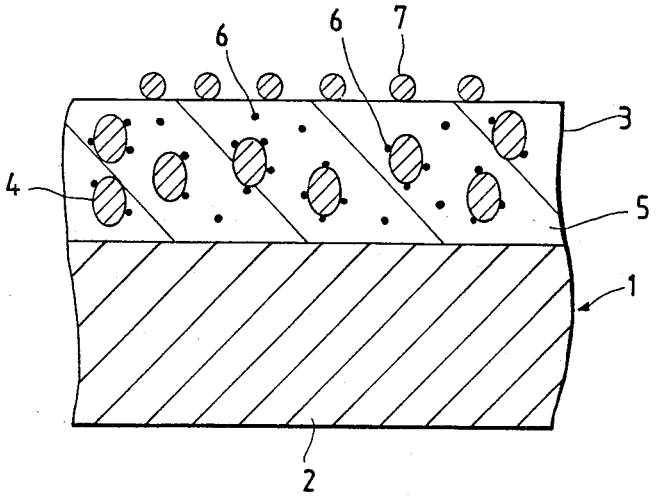
FIG. 1 PRIOR ART
FIG. 1 is a schematic view, in section, of a known dye receiving sheet.

Reference is now made to the accompanying drawings. First, a prior-art dye-receiving sheet of FIG. 1 is described briefly, in which there is provided a dye-receiving sheet 1. The sheet 1 has a substrate 2 and a color-developing layer 3 formed on the substrate 2. The layer 3 includes fine particles 4 of an inorganic material dispersed in a resin binder 5. In this known sheet 1, color-developing sites or points 6 are fully covered with the resin binder 5, by which dye molecules 7 sublimated from a dye layer of a dye transfer sheet (not shown) by application of heat from outside of the dye transfer sheet cannot penetrate into the color-developing layer 3. In other words, the dye molecules deposited on or arrived at the surface of the color-developing layer 3 do not substantially contact with the color-developing sites 6 in the layer 3. As a result, the dye molecules cannot fully develop a color thereof, and also tend to suffer from the influence of the external environment, leading to poor stabilities and particularly poor light resistance. In addition, the dye is deposited only on the outer surface of the layer as an outermost layer, so that the dye image may be readily contaminated with water or oils causing a considerable lowering of the image quality.

Figure 2:
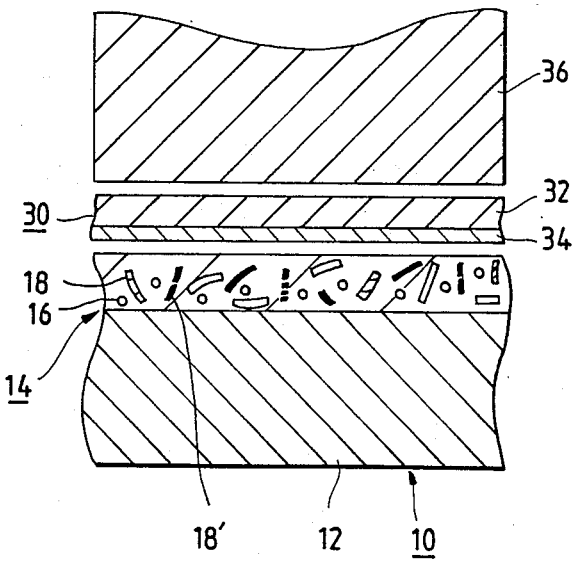
FIG. 2 is a schematic, sectional view illustrating the manner of thermal recording using a dye-receiving sheet according to the invention.

FIG. 2 shows the principle of thermal recording using a dye-receiving sheet according to the invention. In FIG. 2, there is shown a dye-receiving sheet 10 which includes a support 12 and a color-developing layer 14 formed on the support 12 similar to the prior art sheet. The layer 14 is made of fine particles 16 of inorganic materials dispersed in a mixture of two types of resins which are not miscible with each other. One resin has good dye receptivity or good affinity for dyes. In the figure, regions of the respective resins are schematically and roughly depicted as 18 and 18' for the first and second resins, respectively. This mixed resin layer will be described in more detail in FIG. 3.

Above the sheet 10 is provided a dye transfer sheet 30 which includes a support 32 and a sublimable dye layer 34 which is provided in face-to-face relation with the color-developing layer 14. When the dye layer 34 is heated in an imagewise pattern by means of, for example, a thermal head 36, dye molecules sublimate according to the imagewise pattern and deposit on color-developing sites on or in the color-developing layer 14 where a color develops.

Figure 3:
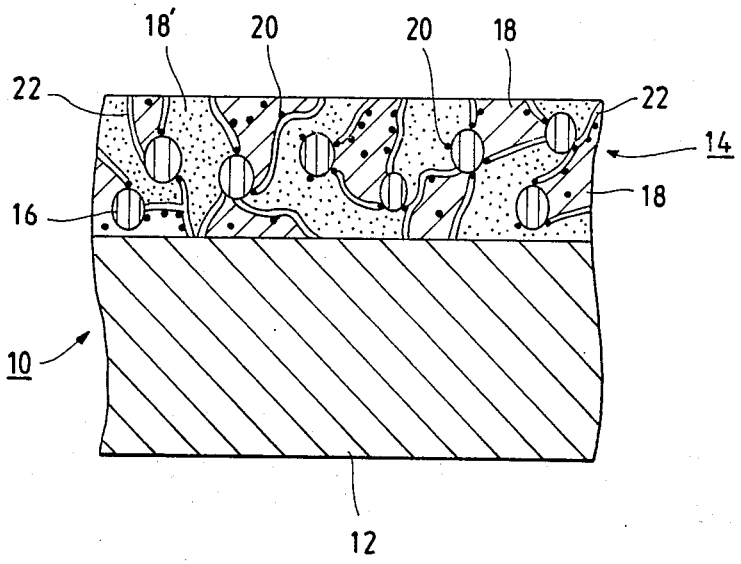
FIG. 3 is a schematic, sectional view showing the dye-receiving sheet of FIG. 2 in detail.

The color development using the color-developing layer 14 is described in FIG. 3 in more detail. In the layer 14 are contained the fine particles 16 dispersed in the resin binder consisting of the regions 18 of the first resin having good affinity for dyes and the regions 18' of the second resin immiscible with the first resin. Because of the immiscibility of both resins, microscopic interstices 22 are formed in the color-developing layer 14 as shown. This is characteristic of the dye-receiving sheet 10 of the present invention. These interstices permit easy passage or penetration of dye molecules into the layer 14. As a result, the dye molecules can arrive at color-developing sites or points 20 in the color-developing layer 14. This is why the dye-receiving sheet according to invention is highly resistant to light and ensures a high recording density.

The first resin having color-developing sites should have functional groups serving as the sites. Preferably, the first resin should have a solubility parameter not smaller than 9.5 and most preferably not smaller than 10.0. Examples of such resins include polyesters, polyamides, acrylic resins and acetate resins. On the other hand, the second resin is immiscible with the first resin. Preferably, the second resin should have a solubility parameter not larger than 9.0 and most preferably not larger than 8.5. Examples of the second resin include hydrocarbon resins, fluorine resins and silicone resins. Specific examples of the hydrocarbon resins are polyethylene, polypropylene, polystyrene, polybutadiene, styrene-butadiene rubber (SBR) and the like.

These hydrocarbon resins, fluorine resins and silicone resins have substantially no color-developing points or sites. Of these resins, hydrocarbon resins including polyethylene are preferred because they are inexpensive and are tack-free in nature, so that they act to prevent a fusion bond between the dye layer 34 and the color-developing layer 14 upon application of heat from the thermal head 36.

In the above arrangement of the dye-receiving sheet of the invention, dye molecules substantially penetrate into the color-developing layer 14 and chemically combine with and/or adsorb on active or color-developing sites of the inorganic particles and the first resin. The disadvantages of the prior art sheet described before can be completely overcome.

Inorganic fine particles dispersed in the resin binder are particles of silica, alumina, titanium oxide, active clay and the like having a size below 10 μm. Preferably, fine particles of silica, alumina and/or titanium oxide having an average size of below 500 angstrom are used. These fine particles are so high in density of color-developing points per unit volume that they greatly contribute to increase the recording density.

The ratio by volume of the second resin to the first resin of high dye receptivity is generally in the range of from 0.1 to 10:1. Outside the range, the effects of the second immiscible resin being mixed with the first resin are lost. The ratio by volume of the fine particles to the total amount of the first and second resins is in the range of 0.1–10:1. With the ratio below 0.1:1, a satisfactory recording density may not be obtained. On the other hand, when the ratio is over 10:1, the binding effect of the resins is unfavorably impeded.

In order to further improve the light resistance and other stabilities of recorded dye images, known UV absorbers and/or antioxidants may be incorporated into the resin binder.

The support may be made of any materials in the form of sheets or films and include paper sheets, synthetic papers and the like as ordinarily used for these purposes.

The dye receiving sheets of the invention may be especially useful when dye transfer sheets make use of sublimable disperse dyes, basic dyes and/or dye formers. The first resins such as polyesters, polyamides, polyacrylic resins and acetate resins permit dye molecules to be dispersed therein and the inorganic fine particles have the ability of adsorbing dye molecules at active or acidic points or sites thereof. This is why stable and clear images can be obtained using the dye-receiving sheets of the invention.

The present invention is described in more detail by way of example

EXAMPLE

Compositions comprising the following three emulsions or dispersions A, B and C in different ratios were prepared and each composition was applied onto a synthetic paper of polypropylene in a thickness of 5 μm by the use of a wire bar, thereby forming a color-developing layer on the paper. The composition was dried to obtain a dye-receiving sheet for thermal recording.

Emulsion A: aqueous emulsion of 20 vol % of polyester (available under the name of Vyrone).

Emulsion B: aqueous emulsion of 20 vol % of polyethylene.

Emulsion C: aqueous dispersion of 20 vol % of silica powder having an average size of 200 angstrom.

On the other hand, dye solutions of 4 parts by volume of each of disperse dyes of the following formulas (I), (II) and (III), 3 parts by volume of polysulfone and 100 parts by volume of monochlorobenzene were prepared. Each solution was applied onto a 12 μm thick condenser paper by the use of a wire bar to obtain a dye transfer sheet for thermal recording.

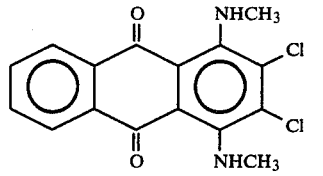

I

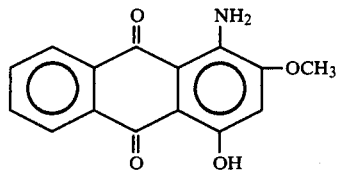

II

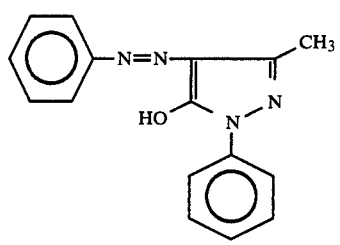

III

The dyes of the formulas (I), (II) and (III) provide cyan, magenta and yellow colors, respectively.

These dye transfer sheets and dye-receiving sheets were brought into intimate contact with each other in pairs so that the formed layers were facing each other. Subsequently, a dye image was formed on the dye-receiving sheet by the use of a thermal head. The recording conditions were as follows.

Line densities of main and sub scannings: 4 dots/mm

Electric power for recording: 0.7 W/dot

Heating time of the head: 8 milliseconds

The resulting dye images were subjected to measurement of a resistance to sunlight according to the method prescribed in JIS L0841. The ratios by volume of the emulsions A and B and the dispersion C, recording densities of the cyan, magenta and yellow colors and the resistance to sunlight are shown in the following table. The resistance to sunlight is evaluated as five grades of 5, 4, 3, 2 and 1 which, respectively, indicate "Very Good", "Good", "Moderate", "Poor" and "Very Poor".

TABLE

| Volume Ratios of Emulsions & Dispersion | | | Recording Densities | | | Light Fastness | | |
|---|---|---|---|---|---|---|---|---|
| A | B | C | Cyan | Magenta | Yellow | Cyan | Magenta | Yellow |
| 9 | 1 | 10 | 1.0 | 0.8 | 0.7 | 3 | 3 | 3 |
| 7 | 3 | 10 | 1.2 | 1.0 | 0.9 | 4 | 4 | 4 |
| 5 | 5 | 10 | 1.4 | 1.2 | 1.0 | 4 | 4 | 5 |
| 3 | 7 | 10 | 1.3 | 0.9 | 1.0 | 4 | 3 | 4 |
| 1 | 9 | 10 | 1.2 | 0.8 | 0.8 | 3 | 3 | 4 |
| 7 | 3 | 50 | 1.3 | 1.2 | 1.0 | 4 | 3 | 4 |
| 5 | 5 | 50 | 1.4 | 1.2 | 1.0 | 3 | 3 | 4 |
| 3 | 7 | 50 | 1.4 | 1.3 | 1.1 | 3 | 3 | 3 |
| 7 | 3 | 2 | 1.2 | 1.1 | 0.8 | 4 | 4 | 5 |
| 5 | 5 | 2 | 1.3 | 1.1 | 0.9 | 4 | 4 | 5 |
| 3 | 7 | 2 | 1.4 | 1.0 | 1.0 | 4 | 3 | 4 |
| 10* | 0* | 10* | 0.8 | 0.7 | 0.6 | 2 | 2 | 3 |
| 0* | 10* | 10* | 1.0 | 0.7 | 0.7 | 2 | 1 | 2 |

*Comparison

The above procedure was repeated except that aqueous solutions or emulsions of polymethyl methacylate, acetyl cellulose and water-soluble polyamide were used as the emulsion A, an SBR latex was used instead of the emulsion B, and an aqueous dispersion of active clay powder having an average size of 1 μm or an aqueous dispersion of alumina or tianium oxide powder having an average size of 300 angstrom was used instead of the dispersion C. The resulting sheets were capable of yielding images having recording densities of cyan, magenta and yellow of over 1.0, over 0.8 and over 0.6, respectively, and a light fastness over 3, inclusive.

For comparison, the above procedure was also repeated using a composition of equal amounts by volume of the emulsion A and the dispersion C and a composition of equal amounts by volume of the emulsion B and the dispersion C, thereby obtain two dye-receiving sheets. The sheets were not satisfactory with respect to the recording densities of all cyan, magenta and yellow colors and the light fastness.

What is claimed is:

1. A heat sublimable dye-receiving sheet for thermal recording comprising a support and a color-developing layer formed on the support, said layer being made of a dispersion of inorganic fine particles having a size below 10 μm in a binder consisting essentially of a first resin having functional groups permitting good dye receptivity and a solubility parameter not less than 10.0 and a second resin immiscible with the first resin and having a solubility parameter not greater than 8.5 whereby microscopic interstices are formed at and along boundaries between the two resins to permit dye molecules to be passed through the interstices.

2. The dye-receiving sheet according to claim 1, wherein said secon resin is a member selected from the group consisting of hydrocarbon resins, fluorine resins and silicone resins.

3. The dye-receiving sheet according to claim 2, wherein said second resin is a hydrocarbon resin.

4. The dye-receiving sheet according to claim 1, wherein a ratio by volume of said second resin to said first resin is in the range of 0.1 to 10:1.

5. The dye-receiving sheet according to claim 1, wherein said inorganic fine particles have an average size below 500 angstrom.

6. The dye-receiving sheet according to claim 1, wherein a ratio by volume of said inorganic fine particles to the total amount of the first and second resins is in the range of 0.1 to 10:1.

* * * * *